US005113778A

United States Patent [19]

Paasche et al.

[11] Patent Number: 5,113,778

[45] Date of Patent: May 19, 1992

[54] SYSTEM FOR TRANSFERRING FLUIDS FROM A PIPING SYSTEM IN A SHIP'S HULL TO A TURNING DEVICE, AND VICE VERSA

[75] Inventors: George W. Paasche, Stjordal; Ketil Hanssen, Trondheim, both of Norway

[73] Assignee: Golar-Nor Offshore AS, Trondheim, Norway

[21] Appl. No.: 683,090

[22] Filed: Apr. 10, 1991

Related U.S. Application Data

[63] Continuation of Ser. No. 442,099, Nov. 28, 1989, abandoned.

[30] Foreign Application Priority Data

Nov. 28, 1988 [NO] Norway ..... 885306

[51] Int. Cl.[5] ..... B63B 27/34

[52] U.S. Cl. ..... 114/256; 441/5; 166/344

[58] Field of Search ..... 441/4, 5; 114/230, 293, 114/256; 166/344, 352; 141/387, 388; 285/136, 168, 190, 282

[56] References Cited

U.S. PATENT DOCUMENTS

| | | | |
|---|---|---|---|
| 3,440,671 | 4/1969 | Smulders | 441/5 |
| 3,525,312 | 8/1970 | Beck | 114/256 |
| 3,590,407 | 7/1971 | Bratiana | 114/256 |
| 3,602,302 | 8/1971 | Kluth | 166/352 |
| 3,612,177 | 10/1971 | Gassett et al. | 166/344 |
| 3,619,832 | 11/1971 | Westra | 441/5 |
| 3,945,066 | 3/1976 | Davies | 441/5 |
| 4,130,077 | 12/1978 | Person et al. | 114/230 |
| 4,602,586 | 7/1986 | Ortloff | 441/5 |
| 4,639,228 | 1/1987 | Bulow | 441/5 |
| 4,690,181 | 9/1987 | Carrio | 114/230 |

*Primary Examiner*—Sherman Basinger
*Assistant Examiner*—Thomas J. Brahan
*Attorney, Agent, or Firm*—Dykema Gossett

[57] ABSTRACT

A system for transferring fluids from a piping system in a ship'hull (2) to a turning device (5) which is rotatably connected thereto, during offshore produciton of oil or gas. The turning device is arranged for being anchored to the sea floor and for connection with at least one flexible riser (12, 13) and with hoses (56, 57, 76, 77), which are connected with the piping system via a manifold (14, 15) for each flow of fluid.

In order to permit unlimited mutual rotation of the turning device and the hull, sets of first coupling halves (54, 55, etc.) are provided along the periphery of the turning device (5), and are connected with manifolds (14, 15). Each set comprises two first coupling halves for each manifold, and for each manifold two hoses (56, 57, 76, 77) are provided, which are connected with the piping system, and which have a second coupling half (60, 61, 80, 81) which is arranged for connection with said first coupling halves, each hose being long enough to permit the turning device (5) to turn both ways relative to said hull over an angular distance corresponding to the angular distance between adjacent sets of first coupling halves, without said hoses being completely tensioned, when the second coupling half of the hose is connected with one of said first coupling halves.

2 Claims, 2 Drawing Sheets

SYSTEM FOR TRANSFERRING FLUIDS FROM A PIPING SYSTEM IN A SHIP'S HULL TO A TURNING DEVICE, AND VICE VERSA

This is a continuation of copending application Ser. No. 07/442,099 filed on Nov. 28, 1989, now abandoned.

BACKGROUND OF THE INVENTION

1. Field of the Invention

The invention relates to a system for transferring fluids from a piping system which is firmly connected with a ship's hull, to a turning device, and vice versa, in which the turning device is rotatably connected with said hull and adapted to be anchored to the sea floor and to be connected with at least one flexible riser, which is connected with respective devices that are firmly connected with the sea floor and with hoses which are connected with tanks in said hull, via a manifold for each riser provided on the upper portion of the turning device.

2. Description of the Prior Art

Systems of this kind are used in production of oil and gas from offshore fields. The vessel could, alternatively, be firmly anchored to the sea floor, being all the time maintained above the gas or oil well with its longitudinal axis directed the same way.

Great forces to which anchoring means are subjected when a vessel lies across the wind and wave direction, however, make such anchoring difficult. This is avoided by, in stead, anchoring the vessel, via a turning device or turntable which is provided substantially midship and can turn about a vertical axis relative to the ship's hull, and which is firmly anchored to the sea floor by the aid of, e.g. chains extending radially away from the turntable and down to the sea floor, so that the turntable cannot rotate about its vertical axis relative to the sea floor. The vessel is made vane stable, so that it will automatically seek to find a position with its bow facing the wind. In order to transfer oil and gas from the wells to the tanks in said hull, there are provided flexible risers which connect the well with the turntable, and hoses which permanently connect the turntable with the tanks, said hoses during rotation of the vessel due to changing wind being wound about the turntable. Due to the large diameter (approximately 25 m) of the turntable, and the weight and diameter of hoses, the hose length is limited which, in turn, limits the total mutual rotation of the turning device and the hull to approximately 360°. If, however, the vessel turned over said angle, and the weather will probably cause further rotation, the vessel must be turned in the opposite direction, e.g. by the aid of a thruster to unwind the hoses from the turntable. During such operations the vessel will periodically have its broadside against the wind. Since the vessel is connected with the wells and production goes on during such turning operations, it will be obvious that such a maneuver is most hazardious, especially if the wave height and the wind velocity are high.

SUMMARY OF THE INVENTION

It is an object of the invention to provide a system of the above mentioned kind which is not burdened with the above mentioned disadvantages.

The characterizing features of the system according to the invention will appear from the characterizing part of the claims.

The invention will now be disclosed in more detail with reference to the drawings, which show an embodiment of a system according to the invention.

DESCRIPTION OF THE PREFERRED EMBODIMENT

Figure 1:
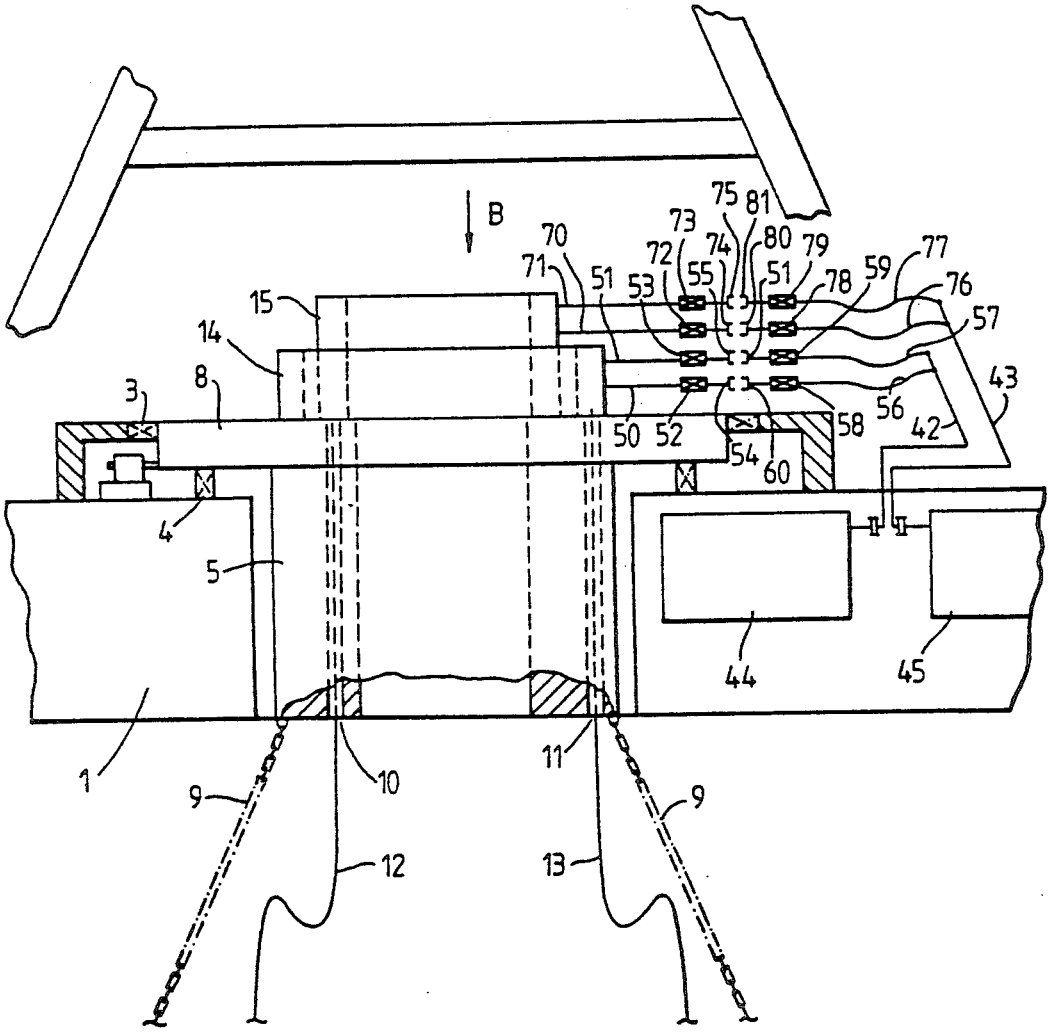
FIG. 1 is a diagrammatical lateral elevation of part of a vessel which is anchored to the sea floor and with a system according to the invention.

In FIG. 1 a vessel 1 in shown, in the hull 2 of which a turning device or turntable 5 is mounted, via bearings 3, 4, so as to be able to turn about a vertical axis 6. Turntable 5 is anchored to the sea floor, via chains 9, or the like, to be non-rotatable relative to the sea floor.

Through two axially extending through holes 10, 11 in the turntable 5 respective flexible risers 12, 13 extend from oil wells (not shown) to two associated, e.g. ring shaped manifolds 14, 15, which are mounted coaxially on upper portion 8 of the turntable.

Above the turntable a derrick 16 is mounted to be firmly connected with the hull 2.

Sets of pipes 48, 48', 48" extend radially from the manifolds, preferably with equal mutual angular distances, each set of pipes comprising two pipes 50, 51, 70, 71, 50', 51', 70', 71', etc., which are connected with the external, or the internal manifold 14, 15, respectively. Each of these pipes is provided with a shut-off valve 52, 53, 72, 73, 52', 53', etc., and a coupling half 54, 55, 74, 75, 54', 55', etc. Coupling halves may be provided close to the periphery of upper portion 8 of the turntable 5.

From two tanks 44, 45 in the hull 2 respective pipes 42, 43 extend upwards to the level of manifolds. The pipes 42, 43 are connected with pairs of hoses 56, 57, and 76, 77, respectively, which can be shut off by shut-off valves 58, 59, 78, 79, and which are finished by coupling halves 60, 61, 80, 81. The pipes 50, 51 may be coupled to the hoses 56, 57 by the aid of the coupling halves 54, 60, and 55, 61, respectively, and the pipes 70, 71 may be coupled to the hoses 76, 77 by the aid of the coupling halves 74, 80, and 75, 81, respectively. The length of the hoses is sufficient to permit the turntable 5 to turn without being hampered by the hoses over an angular distance which is at least slightly larger than the mutual angular distance between adjacent sets of radial pipes when the coupling halves are joined.

Figure 2:
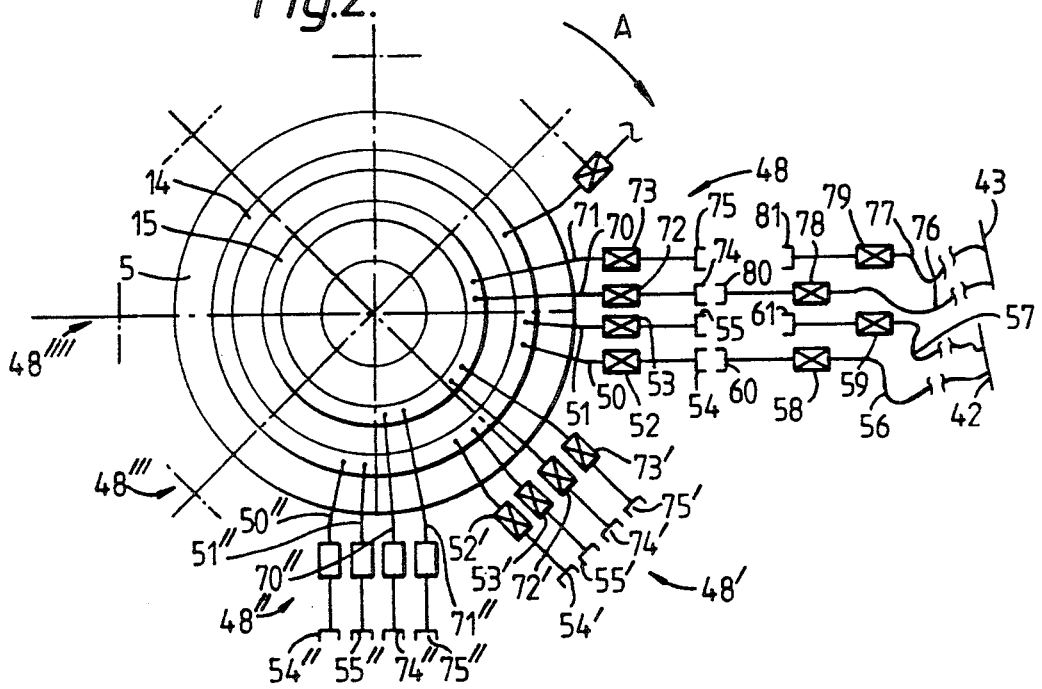
FIG. 2 is a diagrammatical view of the turning device and a piping system connecting the latter with two tanks, as seen in the direction of the arrow B in FIG. 1.

In operation the system is used in the following manner:

For a start, it is assumed that the hoses 56, 76 are connected with the associated pipes 50, 70 of the pipe set 48, via the coupling halves 54, 74, 60, 80, as shown in FIG. 2, and that the shut-off valves 52, 72, 58, 78 are open, whereas the shut-off valves 53, 73, 59, 79 are closed. Well fluid can, thus, flow to the tank 44, via the pipe 50 and the hose 56, and to the tank 45, via the pipe 70 and the hose 76. Since the coupling halves 54, 74 are positioned close to the locations where the hoses 56, 76 are coupled to the pipes 42, 43, the hoses 56, 76 will have a maximum slack in this mutual position of the turntable and the hull.

Figure 3:
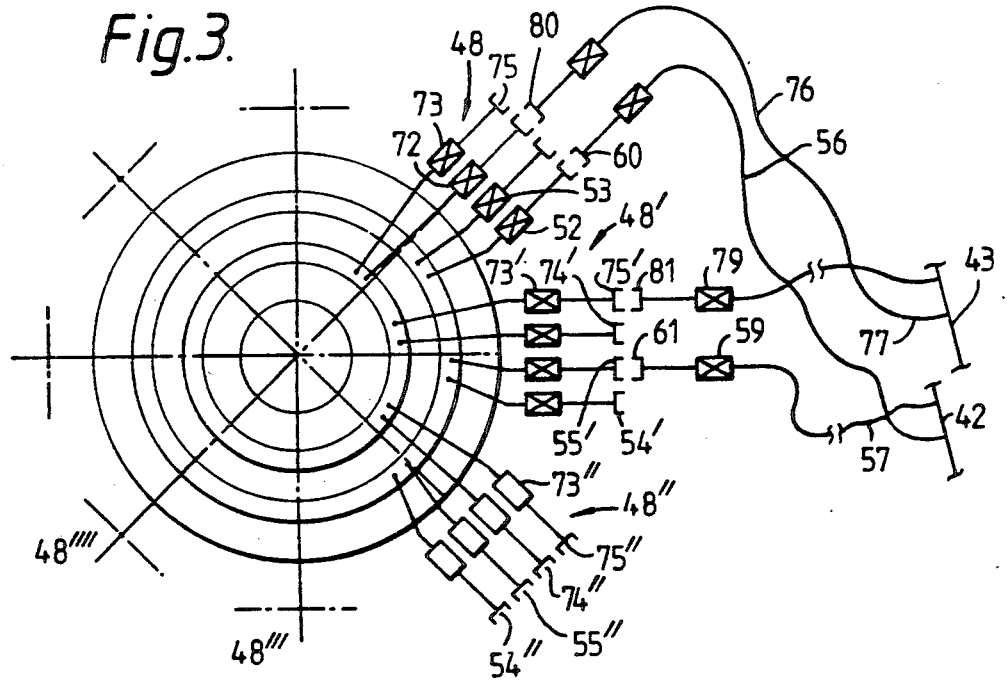
FIG. 3 is a view like FIG. 2, but it shows the turning device in another position relative to the ship's hull.

If the vessel turns, due to changing wind, relative to the turntable in the direction of arrow A, production may still go on without any hazard, via said hoses and pipes, until tensioning of the hoses starts, as shown in FIG. 3.

In this mutual position of the turntable and the hull, the coupling half 81 of the hose 77 is, however, connected with the coupling half 75' of the pipe 71', and the coupling 61 of the hose 57 is connected with the coupling 55' of the pipe 51'. Then the shut-off valves 73', 79, and 53', 59, which are connected with said pipes, are opened, so that well fluids are transferred to respective reservoirs, via all the hoses 56, 57, 76, 77. Then the shut-off valves 52, 58, 72, 78 are closed, and the connection between the coupling halves 54, 60 and 74, 80 is released, so that there is no longer any hazard of tensioning or breakage of associated hoses 56, 76 due to the fact that the vessel turns in the same sense.

During further rotation of the vessel in the same sense and tensioning of the hoses 57, 77, the hoses 56, 77 may be connected with set 48'' of pipes, and the hoses 57, 77 may be disconnected.

In this manner well fluid may continuously flow from the wells to the tanks 44, 45 at the same time as the hull may turn unlimited relative to the turntable, and the hoses 56, 76, and 57, 77 are alternately connected with successive sets of pipes 48, 48', etc., without any hazard for twisting the connecting hoses.

The system is disclosed above in connection with production of well fluid from two wells, but it may also be used for production from a larger number of wells, the turntable then being provided with more manifolds and radial pipes, etc. which connect it with the tanks in the hull.

In stead of an arrangement in which each manifold has a number of sets of relatively long pipes which extend radially outwards, and which are finished by couplings close to the periphery of the upper portion 8 of the turntable 5, annular pipes, which are coaxial with the turntable, may be provided at said periphery. Said annular pipes are connected with respective manifolds by the aid of only one radial pipe. Relatively short radial pipes which are finished by coupling halves and are provided with shut-off valves, as mentioned above, may be connected with each annular pipe.

What we claim is:

1. An apparatus for transferring fluid from a well to a storage tank contained within a ship having a rotating turntable associated therewith, said apparatus comprising:

a manifold rigidly and non-rotatably connected to said turntable and adapted to receive said fluid from said well;

a plurality of flexible hoses coupled to said storage tank; and connection means, coupled to said manifold, for allowing a selected one of said plurality of flexible hoses to be coupled to said manifold, said one hose being selected by an amount of said rotation of said turntable.

2. A method for transferring fluid from a well to a storage tank contained within a hull of a ship, said method comprising:

providing a planar turntable;

rotatably coupling said planar turntable to said ship;

providing a first ring shaped manifold;

rigidly and non-rotatably mounting said first ring shaped manifold upon said turntable;

providing a second ring shaped manifold;

rigidly and non-rotatably mounting said second ring shaped manifold upon said turntable such that said second ring shaped manifold substantially surrounds said first ring shaped manifold;

providing first, second, third, and fourth flexible hoses;

coupling said first flexible hose to said first ring shaped manifold and to said storage tank;

coupling said second flexible hose to said second ring shaped manifold and to said storage tank;

coupling said third flexible hose to said storage tank;

coupling said forth flexible hose to said storage tank;

coupling said third flexible hose to said first ring shaped manifold upon a certain amount of rotation of said turntable;

coupling said fourth flexible hose to said second ring shaped manifold after said third flexible hose has been coupled to said first ring shaped manifold;

removing said first flexible hose from said first ring shaped manifold after said third flexible hose has been coupled to said first ring shaped manifold; and removing said second flexible hose from said second ring shaped manifold after said fourth flexible hose has been coupled to said second ring shaped manifold.

* * * * *